US008200111B2

(12) United States Patent
Hirano

(10) Patent No.: US 8,200,111 B2
(45) Date of Patent: Jun. 12, 2012

(54) PREVENTION OF DEFORMATION OF FIXING UNIT IN IMAGE-FORMING APPARATUS

(75) Inventor: Yasuhiko Hirano, Yokohama (JP)

(73) Assignee: Canon Kabushiki Kaisha (JP)

( * ) Notice: Subject to any disclaimer, the term of this patent is extended or adjusted under 35 U.S.C. 154(b) by 984 days.

(21) Appl. No.: 12/134,822

(22) Filed: Jun. 6, 2008

(65) Prior Publication Data

US 2008/0304847 A1 Dec. 11, 2008

(30) Foreign Application Priority Data

Jun. 11, 2007 (JP) ..... 2007-154401

(51) Int. Cl.
*G03G 15/20* (2006.01)

(52) U.S. Cl. ..... 399/67

(58) Field of Classification Search ..... 399/67, 399/320, 328, 330, 331, 68, 69, 70
See application file for complete search history.

(56) References Cited

U.S. PATENT DOCUMENTS

| | | | | |
|---|---|---|---|---|
| 7,050,747 | B2 | 5/2006 | Fuma et al. | |
| 2006/0029442 | A1 * | 2/2006 | Ide | 399/327 |
| 2007/0059013 | A1 | 3/2007 | Mori et al. | |

FOREIGN PATENT DOCUMENTS

| | | | |
|---|---|---|---|
| JP | 7-28354 | A | 1/1995 |
| JP | 2005-114959 | A | 4/2005 |
| JP | 2006-72125 | A | 3/2006 |
| JP | 2007-41271 | A | 2/2007 |

OTHER PUBLICATIONS

Extended search report issued in corresponding European application No. 08158069.8-2209, dated Oct. 10, 2008.

Japanese Office Action cited in counterpart application No. JP2007-154401, dated Feb. 27, 2012.

* cited by examiner

*Primary Examiner* — David Gray
*Assistant Examiner* — Billy J Lactaoen
(74) *Attorney, Agent, or Firm* — Rossi, Kimms & McDowell LLP

(57) ABSTRACT

An image-forming apparatus capable of satisfactorily maintaining the durability of a separating mechanism while preventing deformation of rubber layers of parts of a fixing unit and at the same time achieving a power saving effect. The image-forming apparatus is shifted into a power saving state without a fixing part and a pressurizing part of the fixing unit being separated. The fixing part and the pressurizing part are separated, if a return condition from the power saving state is not satisfied even after elapse of a predetermined time period from when the apparatus has been shifted into the power saving state.

17 Claims, 11 Drawing Sheets

*FIG. 6*

| No. | START OF SLEEP (141) | END OF SLEEP (142) | SLEEP TIME (143) | ROLLER SEPARATION (TOTAL NUMBER OF TIMES) (144) |
|---|---|---|---|---|
| 1 | 2007/04/09 09:00 | 2007/04/09 09:00 | 0:05:00 | YES(0001) |
| 2 | 2007/04/09 09:45 | 2007/04/09 09:55 | 0:10:00 | YES(0002) |
| 3 | 2007/04/09 10:00 | 2007/04/09 10:05 | 0:05:00 | YES(0003) |
| | | | | |
| ..... | | | | |
| | | | | |
| 500 | 2007/04/16 11:05 | 2007/04/16 11:45 | 0:40:00 | YES(0500) |
| 501 | 2007/04/09 11:50 | 2007/04/16 11:55 | 0:05:00 | YES(0501) |
| 502 | 2007/04/16 12:10 | - | - | NO(0501) |

PREVENTION OF DEFORMATION OF FIXING UNIT IN IMAGE-FORMING APPARATUS

BACKGROUND OF THE INVENTION

1. Field of the Invention

The present invention relates to an image-forming apparatus having a fixing unit for fixing an unfixed image onto a record medium, and a control method, a program, and a storage medium therefor.

2. Description of the Related Art

Conventionally, an image-forming apparatus includes a fixing unit for fixing an unfixed image onto a record medium such as a sheet of paper having held thereon the unfixed image. The fixing unit of this type has a heating roller and a pressurizing roller each disposed for rotation and each including a metal roller core around which a rubber layer is formed, and a heating element is provided inside the heating roller. To fix an image unfixedly carried on a record medium onto the record medium, the record medium held and transferred by the heating roller and the pressurizing roller is heated and pressurized by the rollers, with the pressurizing roller pressed against the heating roller.

In such a fixing unit, the heating roller and the pressurizing roller are always disposed in pressure contact with each other. If the pressurizing roller and the heating roller remain in pressure contact for a long time, a problem is caused that the rubber layers of the rollers can be deformed due to load applied thereto. To solve this problem, the heating roller and the pressurizing roller are rotated upon each elapse of a predetermined time period, whereby the deformation of the rubber layers is prevented.

In recent years, however, to reduce power consumption, there is provided a power saving mode to stop power supply to the fixing unit when the fixing unit is not in operation. In the power saving mode, the heating roller and the pressurizing roller cannot be rotated since the power supply to the fixing unit is stopped.

Thus, there has been proposed a roller-separating mechanism for separating the pressurizing roller from the heating roller when the fixing unit is not in operation (see, Japanese Laid-open Patent Publication No. 7-28354). For example, upon each entry into the power saving mode, the roller-separating action is always performed by the separating mechanism to prevent the rubber layers of the rollers from being deformed. As a result, it is possible to reduce the power consumption while preventing deformation of the rubber layers, without rotating the heating roller and the pressurizing roller.

However, there is a limit in durability of a mechanical part of the roller-separating mechanism. If the user's settings are such that the power saving mode is entered upon elapse of a short time period from completion of image formation, the roller-separating action is performed frequently. In that case, the limit in durability of the mechanical part of the separating mechanism can be reached before expiration of the service life of the fixing unit. Thus, the fixing unit cannot be used when the service life of the mechanical part of the separating mechanism expires, which poses a problem.

SUMMARY OF THE INVENTION

The present invention provides an image-forming apparatus capable of satisfactorily maintaining the durability of a separating mechanism while preventing deformation of rubber layers of parts of a fixing unit of the apparatus and at the same time achieving a power saving effect, and provides a control method, a recording medium, and a program therefor.

According to a first aspect of this invention, there is provided an image-forming apparatus including a fixing unit having a fixing part and a pressurizing part disposed for pressure contact with the fixing part, the fixing unit being adapted to fix an image formed on a record medium using the fixing part and the pressurizing part, the image-forming apparatus comprising a separating unit configured to separate the fixing part and the pressurizing part, and a control unit configured to shift the image-forming apparatus into a power saving state without the fixing part and the pressurizing part being separated by the separating unit, wherein the control unit causes the separating unit to separate the fixing part and the pressurizing part, in a case where a return condition from the power saving state is not satisfied, after elapse of a predetermined time period from when the image-forming apparatus has been shifted into the power saving state.

According to a second aspect of this invention, there is provided an image-forming apparatus including a fixing unit having a fixing part and a pressurizing part disposed for pressure contact with the fixing part, the fixing unit being adapted to fix an image formed on a record medium using the fixing part and the pressurizing part, the image-forming apparatus comprising a separating unit configured to perform a separating action to separate the fixing part and the pressurizing part, a counting unit configured to count a number of times of separation between the fixing part and the pressurizing part by the separating action of the separating unit, and a control unit configured to control the separating action of the separating unit based on a result of counting by the counting unit in a case where the image-forming apparatus is shifted into the power saving state.

According to third and fourth aspects of this invention, there are provided methods each for controlling the image-forming apparatus according to the first or second aspect of this invention.

According to fifth and sixth aspects of this invention, there are provided storage media each computer-readably storing a program for controlling the image-forming apparatuses according to the first or second aspect of this invention.

According to seventh and eighth aspects of this invention, there are provided programs each for controlling the image-forming apparatus according to the first or second aspect of this invention.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principle of the invention.

FIG. 6 is a view showing a history table;

DETAILED DESCRIPTION OF THE PREFERRED EMBODIMENTS

The present invention will now be described in detail below with reference to the drawings showing preferred embodiments thereof.

First Embodiment

[Construction of Image-Forming Apparatus]

Figure 1:
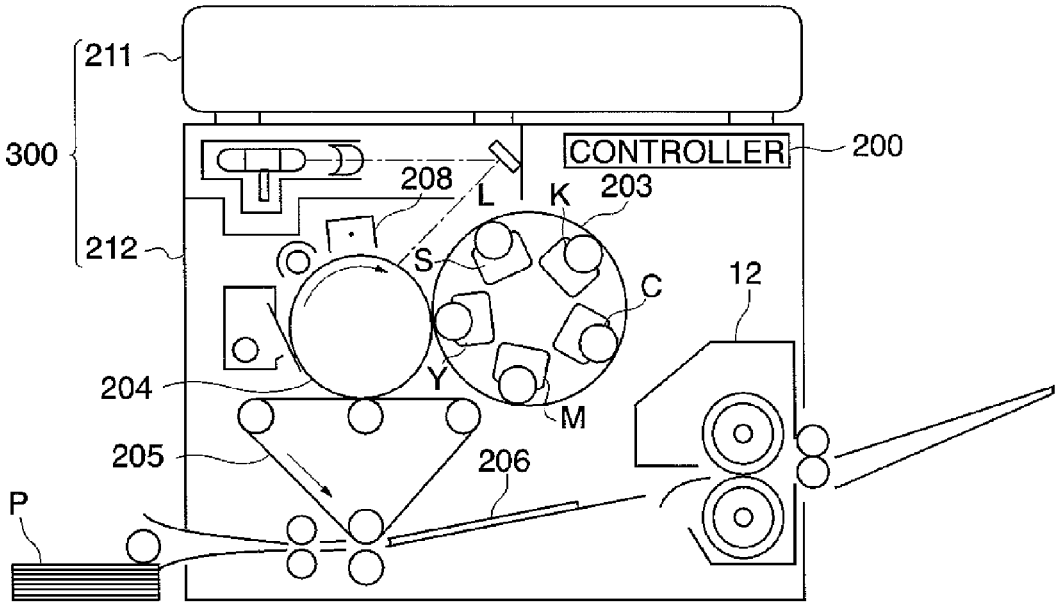
FIG. 1 is a section view schematically showing the construction of an image-forming apparatus having a fixing unit according to a first embodiment of this invention.

FIG. 1 schematically shows in section view the construction of an image-forming apparatus having a fixing unit according to the first embodiment of this invention.

The image-forming apparatus 300 is comprised of a scanner unit 211 and a printing unit 212.

The scanner unit 211 is comprised of an irradiation lamp, a short-focus lens array, a CCD sensor, etc. When an original placed on an original table is scanned while being irradiated by the irradiation lamp, scanning light is reflected from the original and reflected light is focused by the short-focus lens array to form an image on the CCD sensor. The CCD sensor converts a light signal into an electric charge signal, and resultant analog image signal is subjected to a known image process in which the analog image signal is converted into a digital image signal and supplied to the printing unit 212.

In the printing unit 212, a photosensitive drum 204 (latent-image carrier) is charged to a predetermined potential by a charger 208 when a start key is pressed, and light emission from a solid-state laser element is turned on and off in accordance with the image signal supplied to the printing unit 212. The photosensitive drum 204 is scanned over a surface thereof with the light emitted from the laser element, whereby an electrostatic latent image of a first color corresponding to the original image is formed on the surface of the photosensitive drum 204.

Next, the electrostatic latent image is developed by a developing unit 203Y for the first color, among rotary-type developing units 203 (developing means) having developers for respective colors, whereby a toner image (visible image) is formed on the photosensitive drum 204. The toner image formed on the photosensitive drum 204 is transferred onto an intermediate transfer member 205. Subsequently, with developing units 203M to 203S, toner images of other colors are sequentially formed on the photosensitive drum 204. The toner images are transferred in layers onto the intermediate transfer member 205, and collectively transferred onto a transfer material 206 such as a sheet of paper, whereby an image is unfixedly carried on the transfer material 206. The transfer material 206 (record medium) on which the unfixed image has been formed is transferred to the fixing unit 12 in which the unfixed image is thermally fixed onto the transfer material 206 and from which the transfer material 206 is discharged.

The image-forming apparatus 300 includes a controller 200 for centrally controlling the overall apparatus.

In this embodiment, the developing units 203Y, 203M, 203C and 203K incorporated in the rotary-type developing unit 203 are for yellow, magenta, cyan, and black, respectively. The developing unit 203S includes, as a coloring material of color other than the four colors, gray toner which is the same in color hue as black toner but different in density therefrom.

Figure 2:
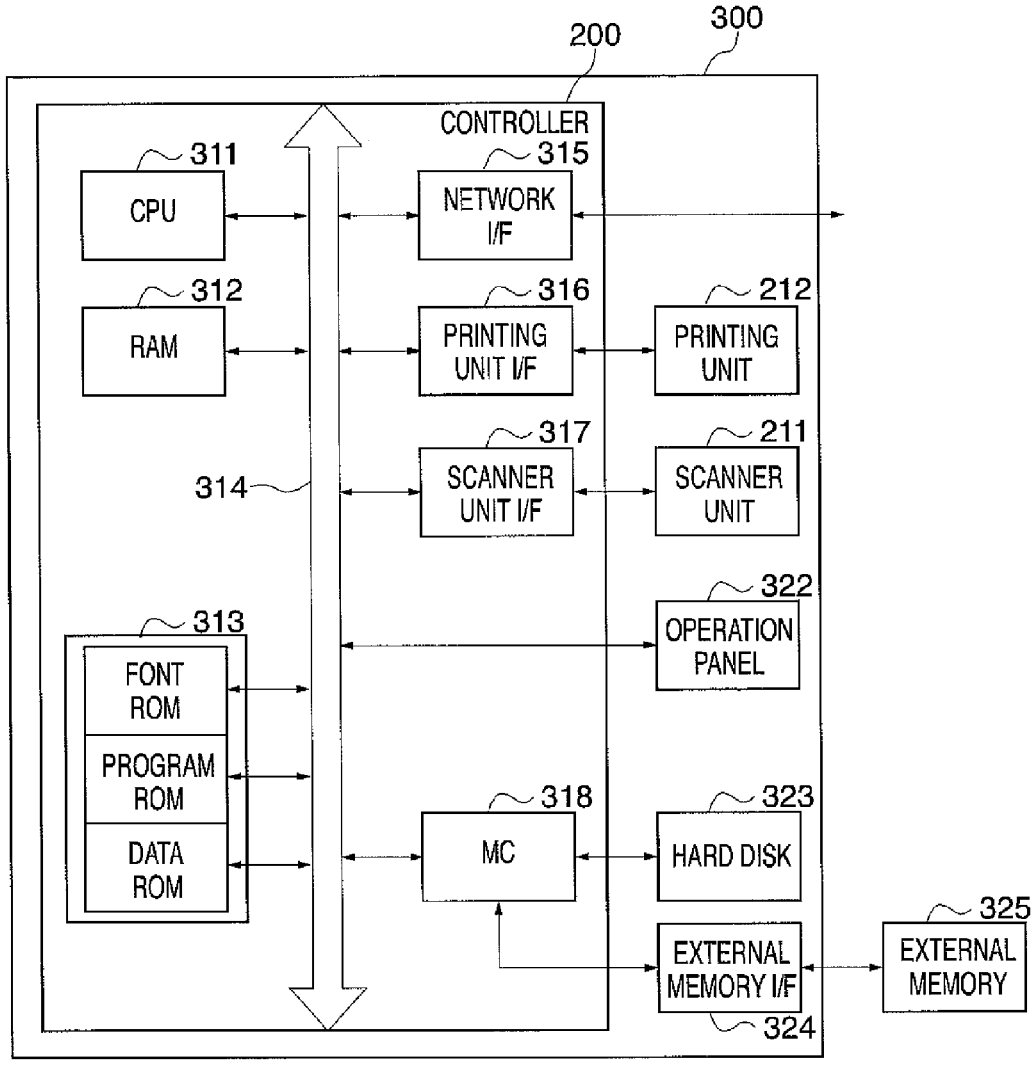
FIG. 2 is a block diagram showing the construction of a controller of the image-forming apparatus.

FIG. 2 shows in block diagram the controller 200 of the image-forming apparatus 300.

The controller 200 includes a CPU 311, a RAM 312, a ROM 313, a network interface (I/F) 315, a printing unit I/F 316, a scanner unit I/F 317, and a memory controller (MC) 318. These modules are interconnected via a system bus 314.

The CPU 311 centrally controls the image-forming apparatus 300 in accordance with a control program stored in a program ROM region of the ROM 313. For example, the CPU 311 inputs image data to be printed from the scanner unit 211 connected thereto via the scanner unit I/F 317, and outputs the image data to the printing unit 212 connected to the CPU 311 via the printing unit interface 316. Furthermore, the CPU 311 receives image data from an external unit via the network interface (I/F) 315, and causes the printing unit 212 to print the image data. The CPU 311 reads out image data stored in the external memory 325, and causes the printing unit 212 to print the image data.

The RAM 312 is a memory that functions as a work area for the CPU 311. The memory capacity of the RAM 312 can be increased using an option RAM adapted to be connected to an expansion port, not shown. For example, the RAM 312 is used as an output information developing area, an environmental data storing area, an NVRAM, or the like. The RAM 312 stores a history table as shown in FIG. 6.

Figure 5A:
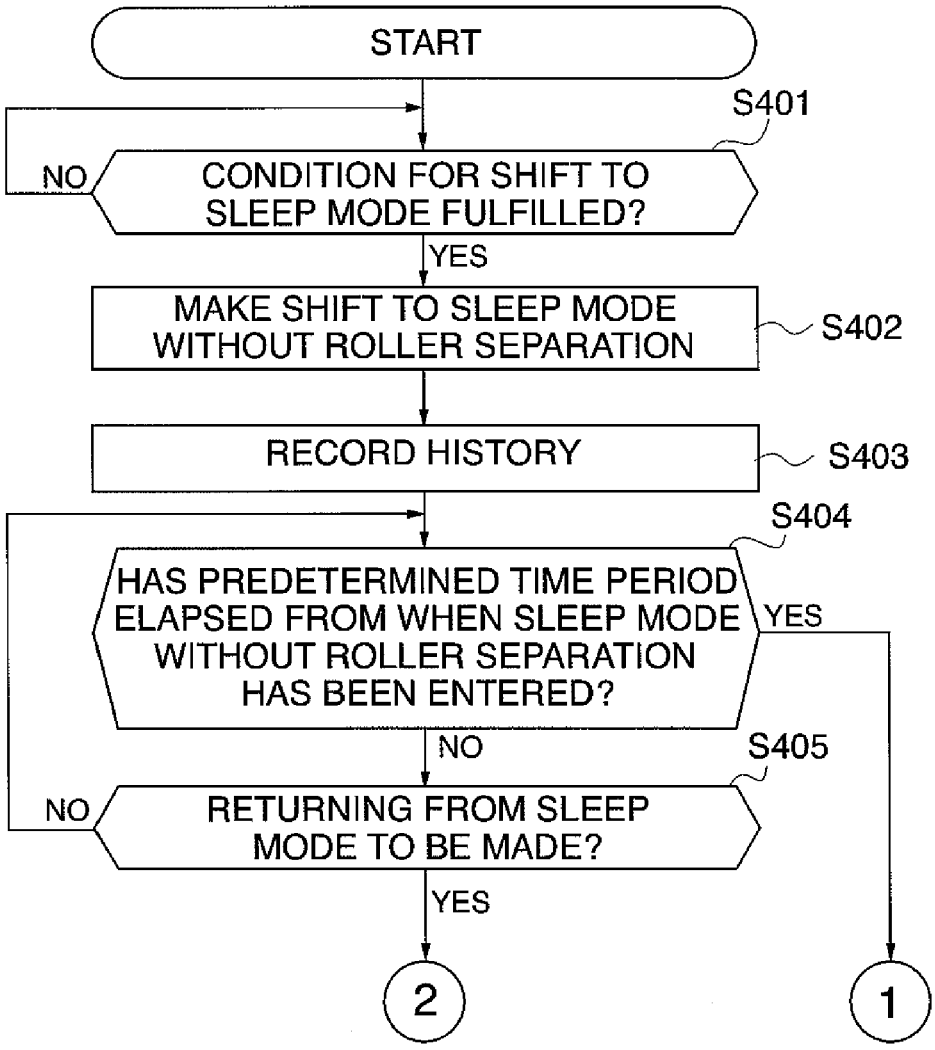
FIGS. 5A and 5B are a flowchart showing a fixing unit control process according to the first embodiment.
Figure 5B:
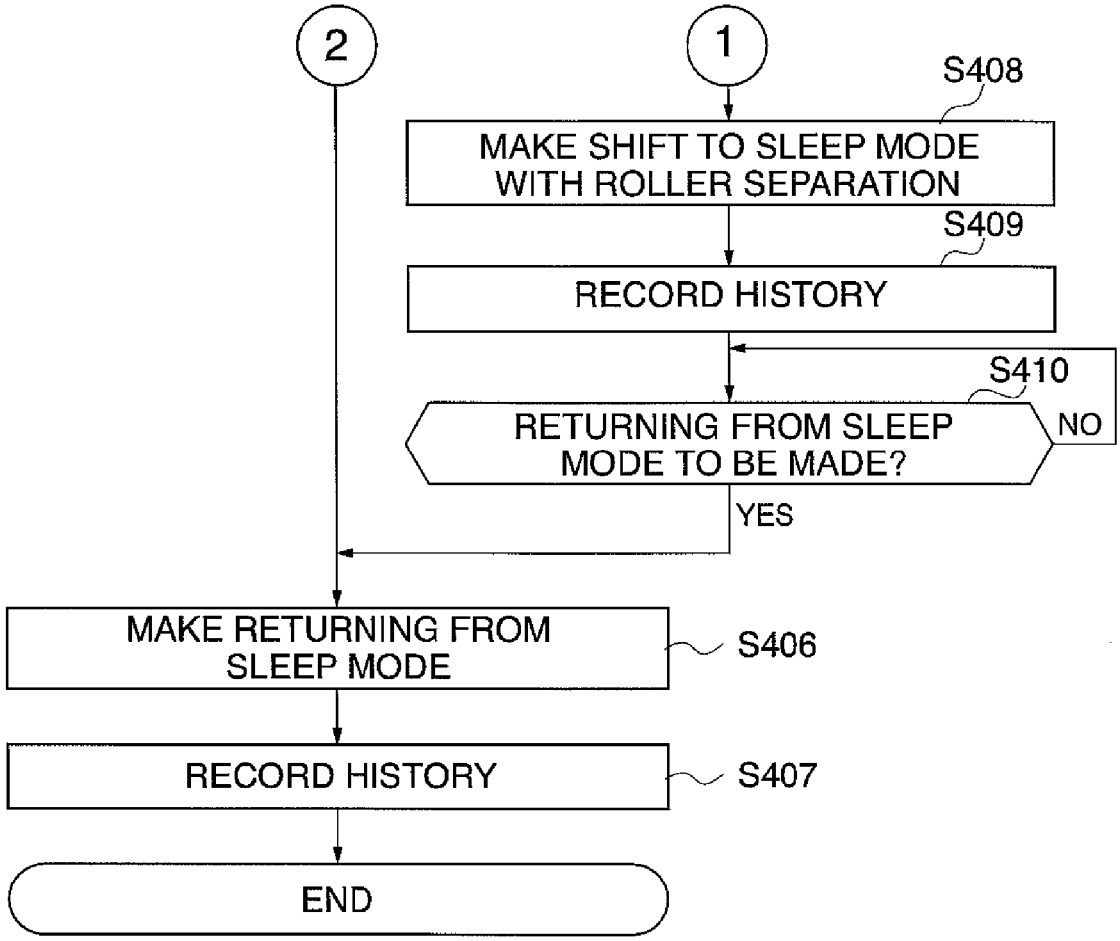

The ROM 313 includes a font ROM, the program ROM, and a data ROM. The program ROM stores, for example, such a control program for the CPU 311 as shown by the flowchart of FIGS. 5A and 5B, and other programs. The font ROM stores font data, etc. for use in generating the output information. The data ROM stores information, etc. for use by an external host computer.

The scanner unit 211 reads an original or the like, and outputs read image data to the system bus 314 via the scanner unit I/F 317. The operation panel 322 has switches for operation, LED display devices, etc. mounted thereon, and is adapted to receive user's instructions. In accordance with instructions received by the operation panel 322, the CPU 311 controls the printing and transmission of image data. A user is able to give, via the operation panel 322, an instruction to make a shift from a normal operation mode to a power saving mode (also referred to as the sleep mode).

The memory controller (MC) 318 controls accesses to the hard disk 323, the external memory 325, etc. The hard disk 323 stores font data, emulation program, form data, etc., and is used for storage of image data to be printed.

The external memory 325 is comprised of an external hard disk, a USB memory, a memory card, or the like, and connected via the external memory I/F 324 to the image-forming apparatus 300. The external memory I/F 324 is comprised of a USB insertion port or a card reader device.

[Construction of Fixing Unit]

Figure 3:
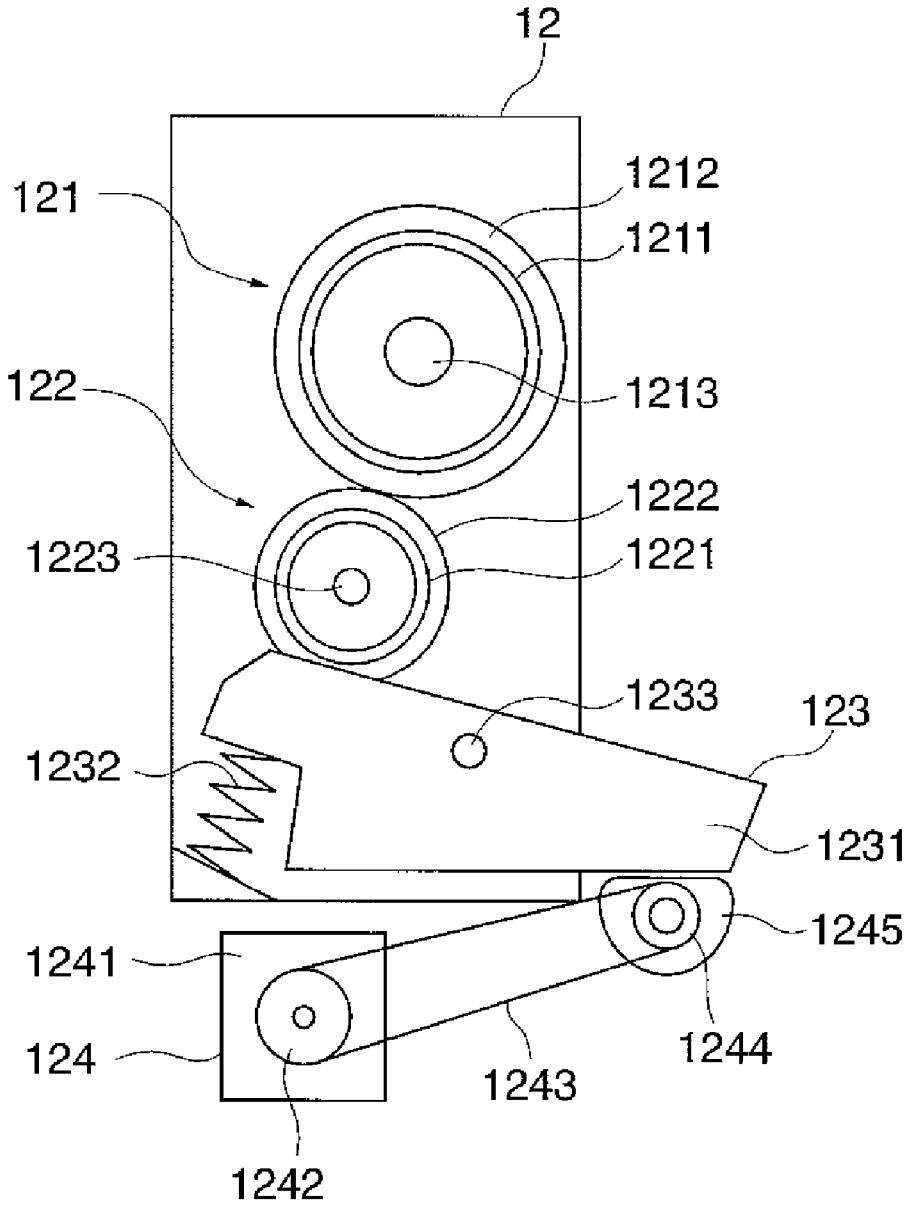
FIG. 3 is a section view showing the construction of the fixing unit in a roller contact state.
Figure 4:
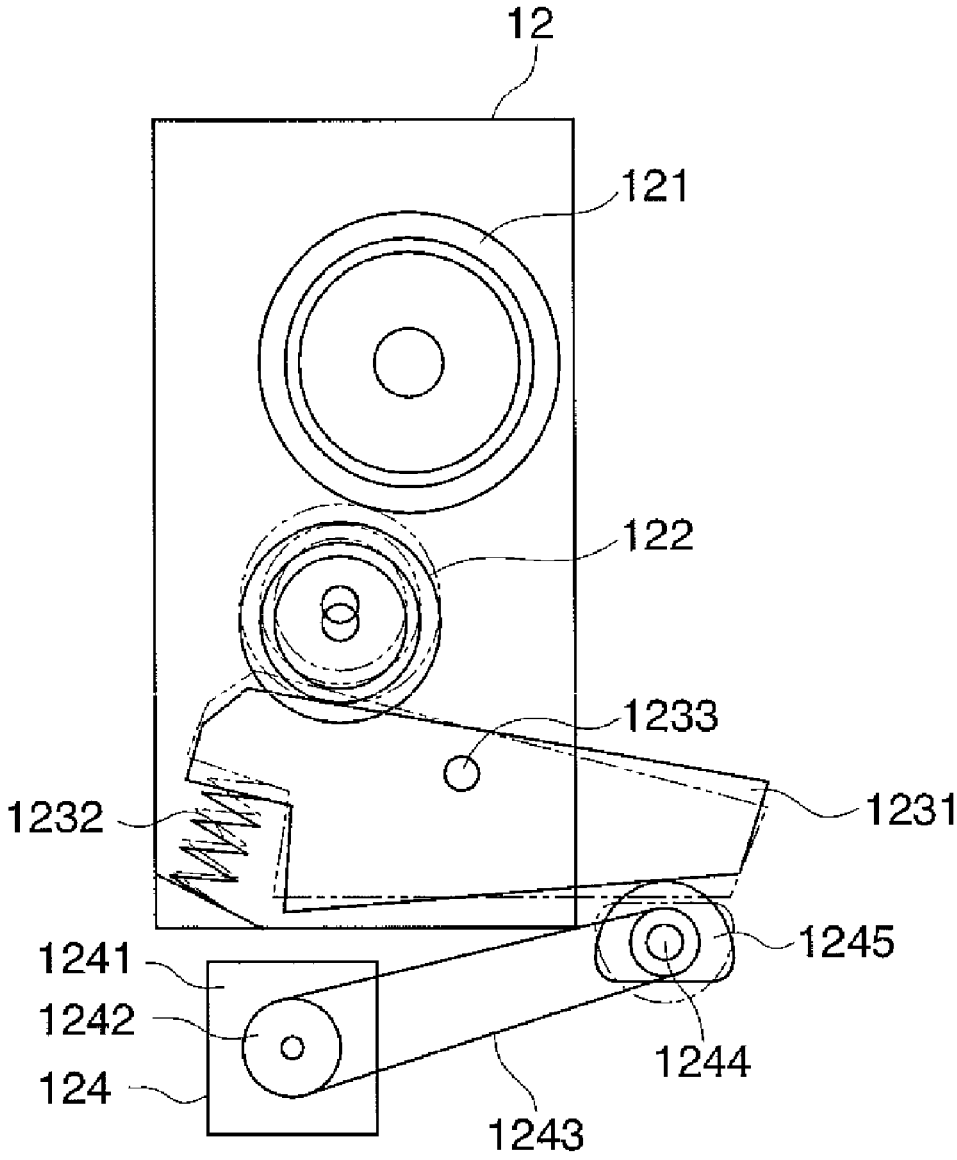
FIG. 4 is a section view showing the construction of the fixing unit in a roller separation state.

FIGS. 3 and 4 show in section view the construction of the fixing unit 12 provided in the printing unit 212 of the image-forming apparatus 300 of this embodiment. FIG. 3 shows the fixing unit 12 in a roller contact state, and FIG. 4 shows the fixing unit 12 in a roller separation state.

The fixing unit 12 is comprised of a heating roller 121 which is a preferred example of a fixing part of the fixing unit, a pressurizing roller 122 which is a preferred example of a pressurizing part of the fixing unit, a roller pressurizing mechanism 123, and a roller-separating mechanism 124. In the fixing unit 12, the pressurizing roller 122 and the heating roller 121 are disposed for pressure contact with each other, and can be rotated by rolling-control means for rotating the rollers.

The heating roller 121 includes a metal roller core 1211 around which a rubber layer 1212 of several mm in thickness is provided. Inside the roller core 1211, there is provided a heater 1213 for heating the heating roller 121. On the other hand, the pressurizing roller 122 includes a metal roller core 1221 having a rubber layer 1222 of several mm in thickness provided therearound. The pressurizing roller 122 is provided at its both ends with roller bearings 1223. The roller pressurizing mechanism 123 pressurizes the pressurizing roller 122 toward the heating roller 121. The roller pressurizing mechanism 123 is comprised of a pressurizing arm 1231, a pressurizing spring 1232, and a rotation center shaft 1233. By means of a spring pressure by the pressurizing spring 1232, the pressurizing arm 1231 can be rotated around the rotation center shaft 1233 so as to press the pressurizing roller 122 upward.

The roller-separating mechanism 124 is for separating the pressurizing roller 122 away from the heating roller 121. If the fixing unit 12 remains unoperated for long time in a roller contact state such as shown in FIG. 3, the rubber layers 1212, 1222 of the pressurizing roller 122 and the heating roller 121 can permanently be deformed. To obviate this, the roller-separating mechanism 124 is provided.

The roller-separating mechanism 124 is comprised of a motor 1241, pulleys 1242, 1244, a belt 1243, and a cam 1245. The pulley 1242 is attached to the motor 1241, and the cam 1245 is rotated by the belt 1243 and the pulley 1244. When the cam 1245 is rotated 180 degrees as shown in FIG. 4, the pressurizing arm 1231 is rotated about the rotation center shaft 1233. As a result, as shown in FIG. 4, the pressurizing roller 122 is separated from the heating roller 121. When the cam 1245 is rotated further 180 degrees, the fixing unit 12 is returned to the roller contact state shown in FIG. 3.

In this example, the motor is used for the roller-separating action. However, a mechanical part of the roller separation mechanism 124 is not limited to the motor, and a solenoid or some other member may be used. Mechanical parts such as motor and solenoid that are used in the roller-separating mechanism 124 are worn away at the time of roller-separating action, and therefore, there is a limit in the number of execution times of roller-separating action. In this embodiment, it is assumed that the service life of mechanical parts such as motor and solenoid is limited to 10,000 times in terms of roller-separating action, but the number of execution times of roller-separating action is not limited to 10,000 times.

[Sleep Mode of Image-Forming Apparatus]

The following is an explanation of types and features of sleep modes provided for the image-forming apparatus 300. In order to reduce power consumption, the CPU 311 of the image-forming apparatus 300 can use the above-described roller-separating mechanism 124 so as to shift the image-forming apparatus 300 from an ordinary state to a first or a second sleep mode as described below when a predetermined condition is satisfied. When the image-forming apparatus 300 is in the ordinary state, the CPU 311 maintains the heating roller 121 and the pressurizing roller 122 of the fixing unit 12 to be in pressure-contact with each other.

The first sleep mode is a "sleep mode without roller separation" into which the image-forming apparatus 300 is shifted without the heating roller 121 and the pressurizing roller 122 being separated from each other but with these rollers remained in pressure-contact with each other. In a case where the image-forming apparatus 300 is shifted into the "sleep mode without roller separation", the CPU 311 shuts off power supply to the printing unit 212 that includes the fixing unit 12. As a result, power consumption can be reduced as compared to that in the ordinary state where electric power is supplied to the printing unit 212. When the image-forming apparatus 300 is shifted into the "sleep mode without roller separation", the CPU 311 regularly causes the heating roller 121 and the pressurizing roller 122 to rotate, thereby preventing the rubber layers of the rollers from being deformed due to the rollers being in pressure-contact with each other for long time.

The second sleep mode is a "sleep mode with roller separation" into which the image-forming apparatus 300 is shifted by the CPU 311 with the heating roller 121 and the pressurizing roller 122 of the fixing unit 12 being separated from each other. In a case where the image-forming apparatus 300 is shifted into the "sleep mode with roller separation", the CPU 311 can shut off the power supply to the printing unit 212 including the fixing unit 12, whereby power consumption can be reduced as compared to that in the ordinary state where electric power is supplied to the printing unit 212. In the case of the image-forming apparatus 300 being shifted into the "sleep mode with roller separation", the heating roller 121 and the pressurizing roller 122 of the fixing unit 12 are not in pressure-contact with each other. As a result, even after elapse of a long time period in such a state, the rubber layers of the rollers are prevented from being permanently deformed due to the rollers being in pressure-contact with each other. Thus, it is unnecessary for the CPU 311 to supply electric power to the fixing unit 12 in order to regularly rotate both the rollers 121, 122. When a shift into the "sleep mode with roller separation" is made, therefore, power consumption can further be reduced than in the "sleep mode without roller separation" in which electric power must be supplied to the fixing unit 12 to regularly rotate the rollers 121, 122.

It should be noted that the CPU 311 can shift the image-forming apparatus 300 from the first sleep mode (the "sleep mode without roller separation") to the second sleep mode (the "sleep mode with roller separation"). In the following, the sleep mode is sometimes referred to as the power saving mode, the sleep state, or the power saving state.

[Control of Fixing Unit]

Next, with reference to FIGS. 5A, 5B and 6, a process for controlling the fixing unit 12 of this embodiment will be described.

FIGS. 5A and 5B show in flowchart the fixing unit control process according to the first embodiment, which is carried out by the CPU 311 in accordance with a program read out by the CPU 311 from the ROM 313.

When the image-forming apparatus 300 is in the ordinary state such as for example when power supply to the apparatus 300 is turned on or when the apparatus 300 is returned from the sleep mode, the CPU 311 starts the control process shown in the flowchart of FIGS. 5A and 5B.

If it is determined in S401 that a predetermined time period for entry into the sleep mode has elapsed without any user operation being made on the image-forming apparatus 300, the CPU 311 proceeds the process to S402. When a user's instruction to shift into the sleep mode is received in S401, the CPU 311 determines that a condition for making a shift to the sleep mode is fulfilled, and proceeds the process to S402. In S402, the CPU 311 shifts the image-forming apparatus 300 into the "sleep mode without roller separation".

In S403, the CPU 311 records information relating to the sleep control in a history table, which is shown in FIG. 6 and relates to the sleep control of the image-forming apparatus 300.

In the history table shown in FIG. 6, a column 141 is for indicating the date and time of start of sleep, a column 142 is for indicating the date and time of end of sleep, a column 143 is for indicating a sleep time calculated by subtracting the date and time of start of sleep from the date and time of end of sleep, and a column 144 is for indicating a flag that represents whether the roller separation has been carried out in the fixing unit 12 during the sleep mode and the total number of execution times of roller separation from when the fixing unit 12 has been attached to the image-forming apparatus 300. In the example of FIG. 6, the history table includes records numbered as No. 1, No. 2, No. 3, and so on arranged from old to new in the order of total number of execution times of sleep mode. In S403, the CPU 311 acquires time information from a timer, not shown, and records the acquired time as the date and time of start of sleep. Further, information of "NO" indicating that a shift to the "sleep mode without roller separation" is made is recorded in the column 144, and the total number of execution times of roller separation which is the same as that recorded in the immediately preceding record is recorded in the column 144. As the initial total number of execution times of roller separation, a value of "0000" may be recorded in the column 144.

When the image-forming apparatus 300 is in the "sleep mode without roller separation", the rubber layers 1212, 1222 of the heating roller 121 and the pressurizing roller 122 of the fixing unit 12 are in a pressure-contact state, and therefore, the CPU 311 regularly (e.g., every three minutes) performs control to rotate the heating roller and the pressurizing roller, e.g., 90 degrees so as to change a pressure-contact portion between the rollers, whereby the rubber layers can be prevented from being deformed.

Next, in S404, the CPU 311 determines whether or not a predetermined time period (e.g., 10 minutes) has elapsed from when the image-forming apparatus 300 has been shifted into the "sleep mode without roller separation". If it is determined in S404 that the predetermined time period has not elapsed from when the image-forming apparatus 300 has been shifted into the "sleep mode without roller separation", the process proceeds to S405.

In S405, the CPU 311 determines, for example, whether or not image data has been received or whether or not an instruction to return from the sleep mode has been given by the user. If neither the image data nor the return instruction is received, the process returns to S404. On the other hand, if the image data or the return instruction is received, the process proceeds to S406.

In S406, the CPU 311 causes the image-forming apparatus 300 to be returned from the sleep mode. In S407, the CPU 311 records information relating to the sleep control in the history table which is shown in FIG. 6 and relates to the sleep control of the image-forming apparatus 300. Specifically, the CPU 311 records the date and time of end of sleep into the column 142, and records a value calculated by subtracting the date and time of start of sleep from the date and time of end of sleep into the column 143.

On the other hand, if it is determined at S404 that the predetermined time period has elapsed from when the image-forming apparatus 300 has been shifted into the "sleep mode without roller separation", the process proceeds to S408. In S408, the CPU 311 causes the image-forming apparatus 300 to shift from the "sleep mode without roller separation" to the "sleep mode with roller separation".

In S409, the CPU 311 rewrites the information of "NO" recorded in the column 144 of the history table shown in FIG. 6 into information of "YES" representing that the image-forming apparatus 300 has been shifted into the "sleep mode with roller separation".

In S410, the CPU 311 determines, for example, whether or not an instruction to return from sleep is given by the user. If the return instruction is given, the process proceeds to S406.

As described above, when a shift to the sleep mode is made, the CPU 311 first causes the image-forming apparatus 300 to shift into the "sleep mode without roller separation". Subsequently, if the predetermined time period has elapsed in this state, the CPU 311 causes the apparatus 300 into the "sleep mode with roller separation". As a result, the rubber layers of the rollers 121, 122 of the fixing unit 12 can be prevented from being deformed and at the same time the power saving effect can be attained. Thus, it is unnecessary to operate the roller-separating mechanism 124 if, for example, the instruction to return from sleep is given by the user before elapse of the predetermined time period from when the apparatus has been shifted into the "sleep mode without roller separation", making it possible to perform control so as to satisfactorily maintain the durability of the roller-separating mechanism 124.

Second Embodiment

In a second embodiment, an example will be described where the roller separation control is carried out using the history table shown in FIG. 6.

Figure 7A:
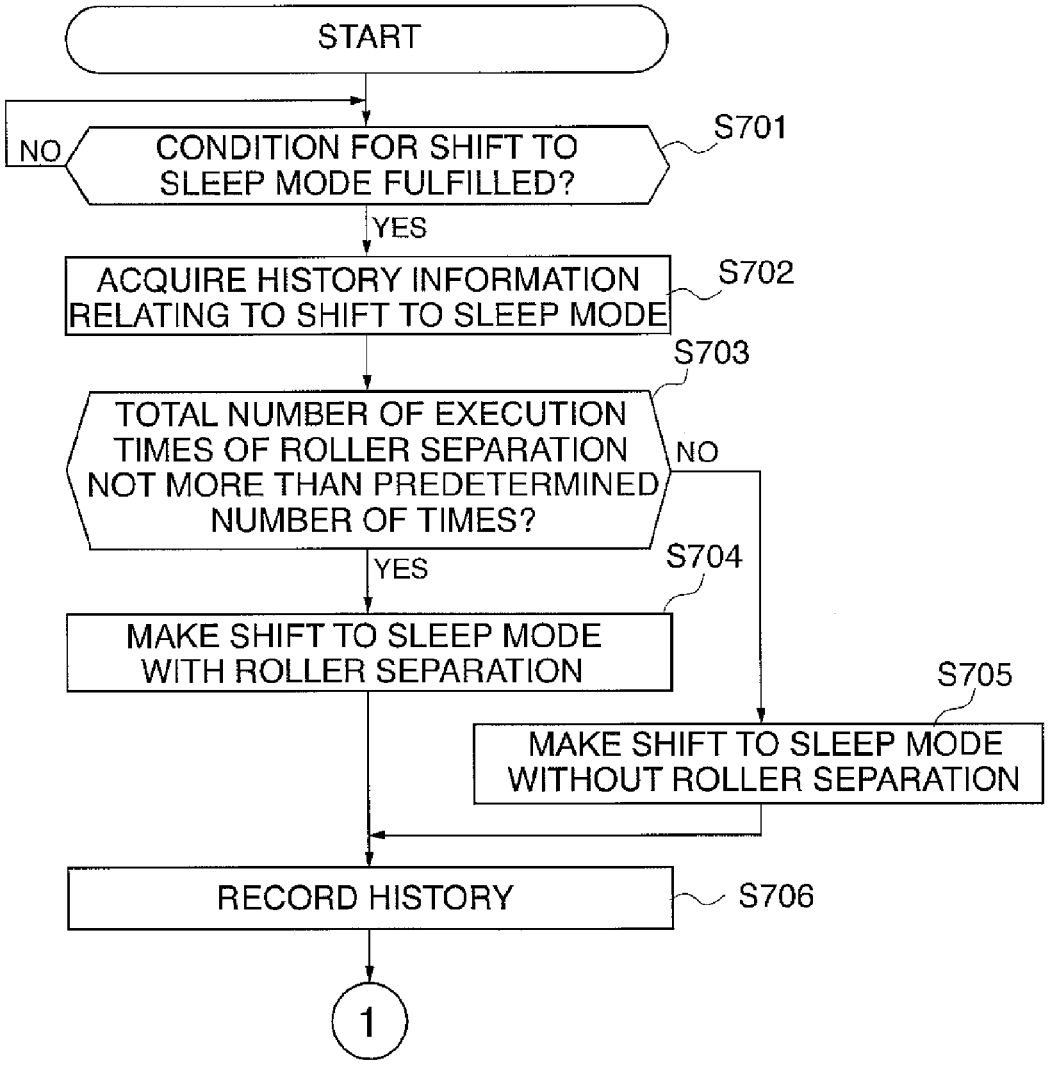
FIGS. 7A and 7B are a flowchart showing a fixing unit control process according to a second embodiment.
Figure 7B:
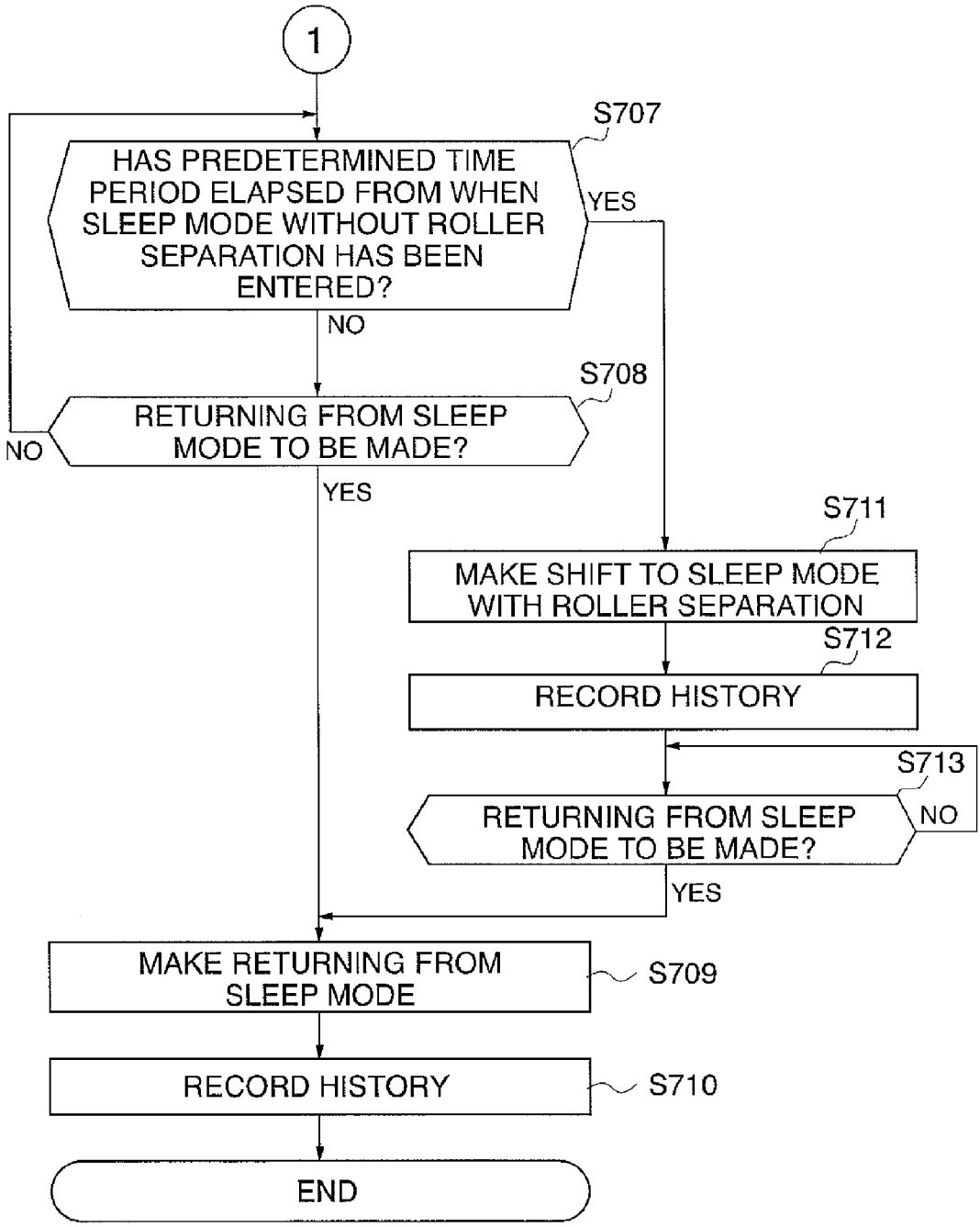

FIGS. 7A and 7B show in flowchart a fixing unit control process according to the second embodiment, which is implemented by the CPU 311 in accordance with a program read out from the ROM 313.

When the image-forming apparatus 300 is in the ordinary state such as for example when power supply to the apparatus 300 is turned on or when the apparatus 300 is returned from the sleep mode, the CPU 311 starts the control process in the flowchart of FIGS. 7A and 7B.

If it is determined in S701 that a predetermined time period for entry into the sleep mode has elapsed without any user operation being made on the image-forming apparatus 300 or a user's instruction to shift into the sleep mode is received, the CPU 311 determines that a condition for shift to the sleep mode is fulfilled.

In S702, the CPU 311 acquires history information relating to sleep mode control from the history table stored in the RAM 312 and shown in FIG. 6. Then, the CPU 311 analyzes the content of the acquired history information to thereby acquire data indicating the total number of execution times of sleep mode. This data also includes the number of execution times of roller separation carried out upon entry into sleep mode in accordance with the user's instruction.

In the next S703, the CPU 311 refers to the history table shown in FIG. 6, and determines whether or not the total number of execution times of roller separation is equal to or less than a predetermined number of times. If it is determined that the total number of execution times of roller separation is equal to or less than the predetermined number of times, the CPU 311 proceeds the process to S704.

In S704, the CPU 311 shifts the image-forming apparatus 300 into the "sleep mode with roller separation".

On the other hand, if it is determined in S703 that the total number of execution times of roller separation is not equal to nor less than the predetermined number of times, the CPU 311 proceeds the process to S705 in which the image-forming apparatus 300 is shifted into the "sleep mode without roller separation".

Next, in S706, the CPU 311 records information relating to sleep control into the history table shown in FIG. 6.

When the image-forming apparatus 300 is in the "sleep mode without roller separation", the rubber layers 1212, 1222 of the heating roller 121 and the pressurizing roller 122 of the fixing unit 12 are in a pressure-contact state. Thus, the CPU 311 regularly (e.g., every three minutes) performs control to rotate the heating roller and the pressurizing roller so as to change a pressure-contact portion between the rollers.

If it is determined in S707 that the image-forming apparatus 300 is already in the "sleep mode with roller separation", the CPU 311 proceeds the process to S708. If it is determined in S707 that the image-forming apparatus 300 is in the "sleep mode without roller separation" but the predetermined time period (e.g., 10 minutes) has not elapsed from when the apparatus 300 has been shifted into the "sleep mode without roller separation", the CPU 311 proceeds the process to S708. On the other hand, if it is determined in S707 that the image-forming apparatus 300 is in the "sleep mode without roller separation" and the predetermined time period has elapsed from when the apparatus 300 has been shifted into the "sleep mode without roller separation", the CPU 311 proceeds the process to S711.

An explanation on S708 to S713 is omitted since these steps are the same in content as 405 to S410 described in the first embodiment.

As described above, the operation of the roller-separating mechanism 124 is controlled based on the information relating to the total number of execution times of roller separation that is managed as history information, whereby control can be carried out to satisfactorily maintain the durability of the roller-separating mechanism 124. Specifically, when the total number of execution times of roller separation is small, the control is performed while attaching importance to prevent deformation of the rubber layers of the rollers 121, 122 of the fixing unit 12 and to attain the power saving effect at the same time. With increase in the total number of execution times of roller separation, the control can be performed while attaching more importance to the durability of the roller-separating mechanism 124.

The above-described predetermined time period for use in comparison in S707 may be determined in advance. Alternatively, the predetermined period can dynamically be set by the CPU 311 by taking the durability of the roller-separating mechanism 124 into consideration. For example, when the total number of execution times of roller separation is equal to or less than 500 times, the predetermined time period is set to be equal to 10 minutes, and the process proceeds to S711 if it is determined in S707 that the time elapsed from when the "sleep mode without roller separation" has been entered exceeds 10 minutes. On the other hand, if the total number of execution times of roller separation exceeds, e.g., 500 times, the "sleep mode without roller separation" should preferably be maintained as long as possible from the viewpoint of improving the durability of the roller-separating mechanism 124. To this end, the CPU 311 sets the predetermined time period to be equal to 20 minutes, which is longer than that set for the case not more than 500 times. Similarly, when the total number of execution times of roller separation exceeds 1000 times, the threshold time period is set to a much longer time period of 30 minutes by taking the durability of the roller-separating mechanism 124 into consideration. With the above described way of settings, the control taking the durability of the roller-separating mechanism 124 into consideration can be achieved, in which the image-forming apparatus 300 is maintained in the "sleep mode without roller separation" for a longer time period with increase in the total number of execution times of roller separation, i.e., with decrease in the remaining service life of the roller-separating mechanism 124.

Third Embodiment

Figure 8A:
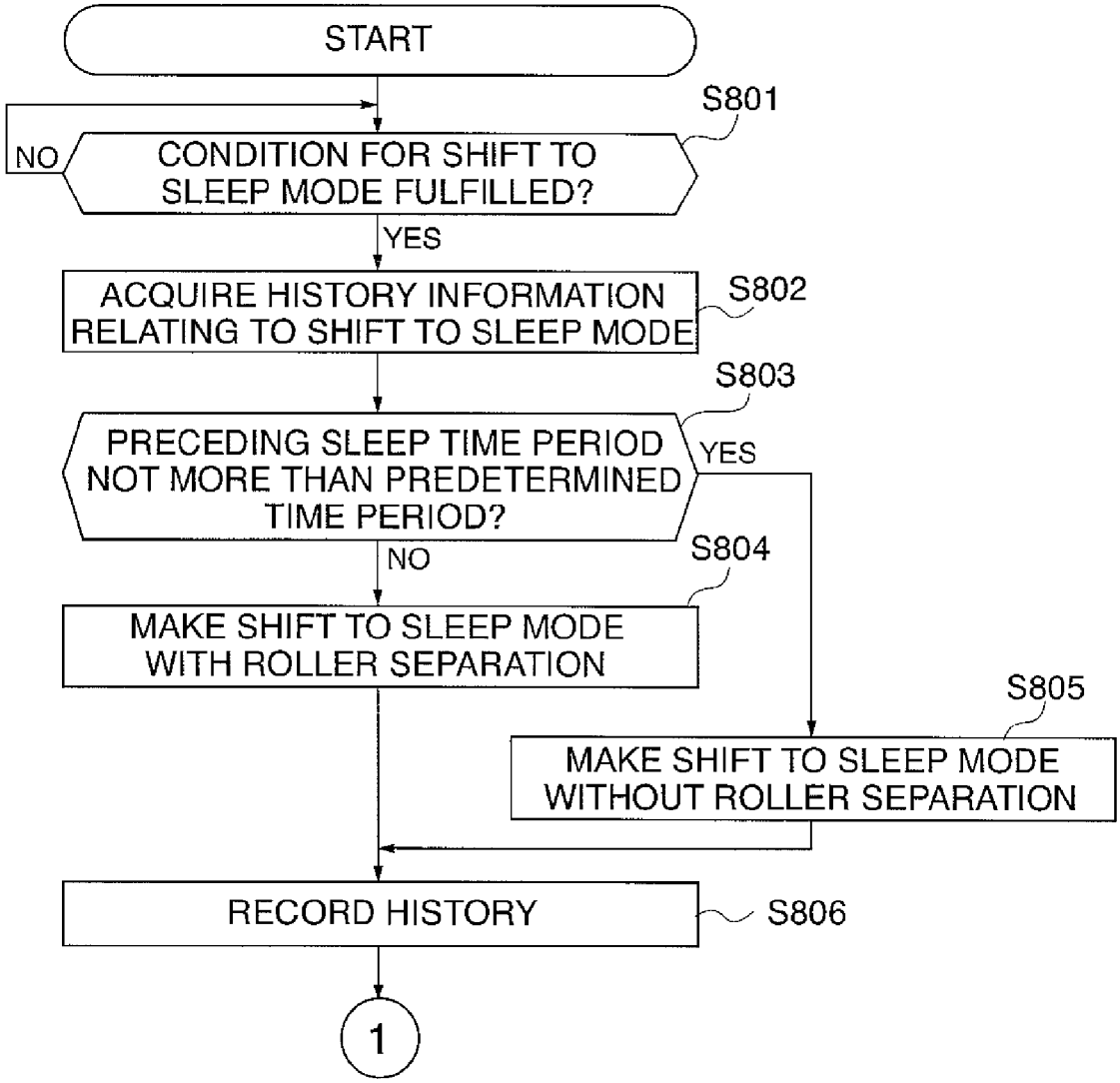
FIGS. 8A and 8B are a flowchart showing a fixing unit control process according to a third embodiment.
Figure 8B:
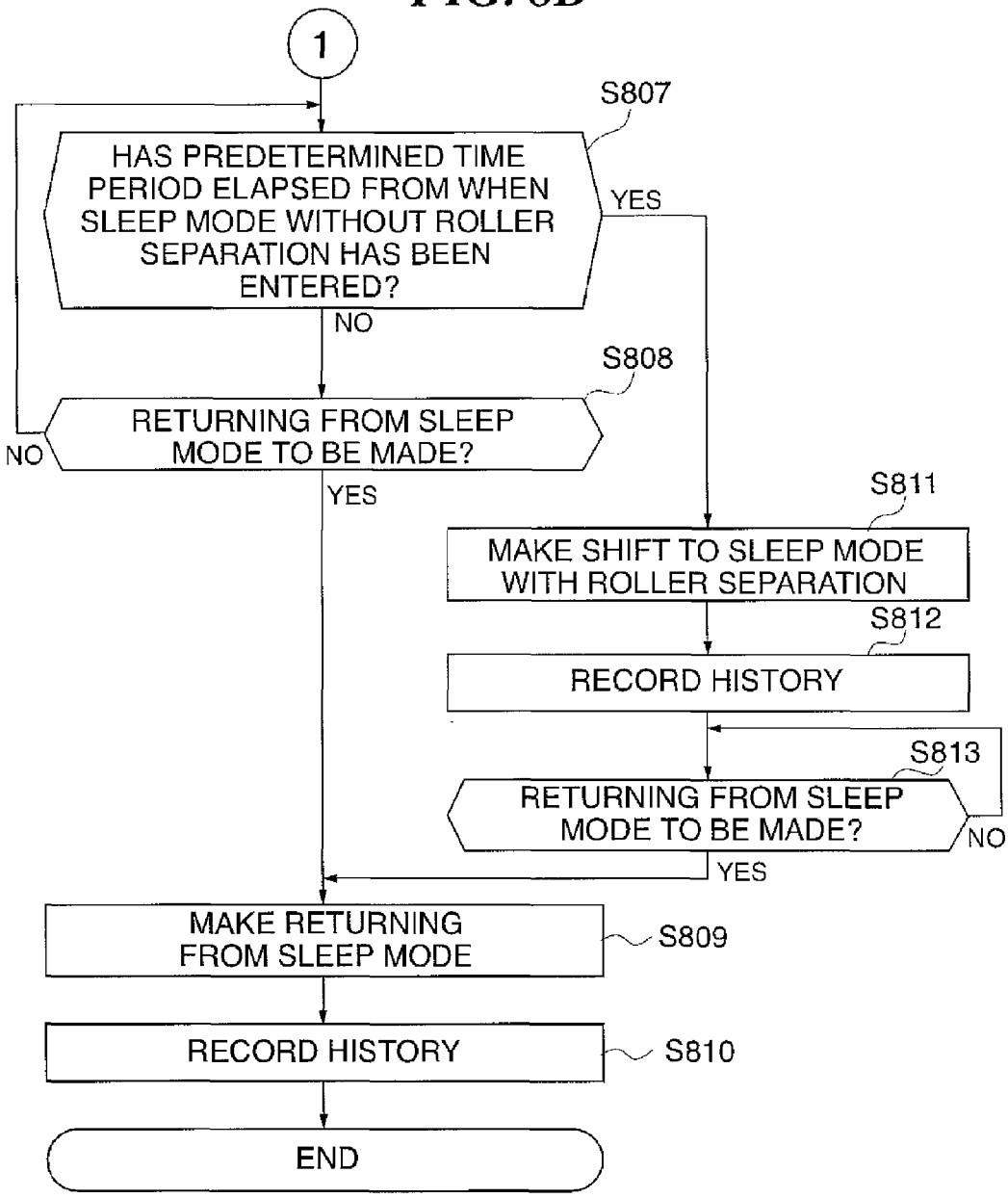

In a third embodiment, another example of control performed using the history table shown in FIG. 6 is described. FIGS. 8A and 8B show in flowchart a fixing unit control process according to the third embodiment, which is implemented by the CPU 311 in accordance with a program read out from the ROM 313.

When the image-forming apparatus 300 is in the ordinary state such as for example when power supply to the apparatus 300 is turned on or when the apparatus 300 is returned from the sleep mode, the CPU 311 starts the control process in the flowchart of FIGS. 8A and 8B.

If it is determined in S801 that a predetermined time period for entry into the sleep mode has elapsed without any user operation being made on the image-forming apparatus 300 or a user's instruction to shift into the sleep mode is received, the CPU 311 determines that a condition for shift to the sleep mode is fulfilled.

In S802, the CPU 311 acquires history information relating to sleep mode control from the history table stored in the RAM 312 and shown in FIG. 6. Then, the CPU 311 analyzes the content of the acquired history information to thereby acquire data indicating the total number of execution times of sleep mode. This data also includes the number of execution times of roller separation carried out upon entry into sleep mode in accordance with the user's instruction.

In the next S803, the CPU 311 refers to the history table shown in FIG. 6, and determines whether or not an immediately preceding sleep time period (i.e., a time period from when the image-forming apparatus 300 was shifted into a sleep state to when the apparatus was returned therefrom in the preceding cycle) is equal to or less than a predetermined time period. If it is determined that the sleep time period is greater than the predetermined time period, the CPU 311 proceeds the process to S804. In S804, the CPU 311 shifts the image-forming apparatus 300 into the "sleep mode with roller separation". On the other hand, if it is determined in S803 that the sleep time period is equal to or less than the predetermined time period, the CPU 311 proceeds the process to S805 in which the image-forming apparatus 300 is shifted into the "sleep mode without roller separation".

Next, in S806, the CPU 311 records information relating to sleep control into the history table shown in FIG. 6.

When the image-forming apparatus 300 is in the "sleep mode without roller separation", the rubber layers 1212, 1222 of the heating roller 121 and the pressurizing roller 122 of the fixing unit 12 are in a pressure-contact state. Thus, the CPU 311 regularly (e.g., every three minutes) performs control to rotate the heating roller and the pressurizing roller, e.g., 90 degrees so as to change a pressure-contact portion between the rollers.

If it is determined in S807 that the image-forming apparatus 300 is already in the "sleep mode with roller separation", the CPU 311 proceeds the process to S808. If it is determined in S807 that the image-forming apparatus 300 is in the "sleep mode without roller separation" but the predetermined time period (e.g., 10 minutes) has not elapsed from when the apparatus 300 has been shifted into the "sleep mode without roller separation", the CPU 311 proceeds the process to S808. On the other hand, if it is determined in S807 that the image-forming apparatus 300 is in the "sleep mode without roller separation" and the predetermined time period has elapsed from when the apparatus 300 has been shifted into the "sleep mode without roller separation", the CPU 311 proceeds the process to S811.

An explanation on S808 to S813 is omitted since these steps are the same in content as 405 to S410 described in the first embodiment.

The control described in this embodiment is based on a presumption that, taking into consideration the manner of usage of the image-forming apparatus 300 by the user, there is a high possibility that the current sleep mode time period is short, if the immediately preceding sleep mode time period was short.

As described above, the operation of the roller-separating mechanism 124 is controlled based on the information relating to the immediately preceding sleep time period managed as history information, whereby control can be carried out to satisfactorily maintain the durability of the roller-separating mechanism 124, while preventing deformation of the rubber layers of the rollers 121, 122 of the fixing unit 12 and attaining the power saving effect at the same time.

The following is a description of a specific example of control based on the history table shown in FIG. 6 in a case that the predetermined time period for use in comparison in S803 is equal to 20 minutes.

In S803, with regard to, e.g., the record No. 501, the CPU 311 compares the immediately preceding sleep mode time period (in the record No. 500) with the predetermined time period, and determines that the immediately preceding sleep mode time period is 40 minutes and not equal to nor less that the predetermined time period of 20 minutes. Thus, the CPU 311 determines that the immediately preceding sleep mode time period is not equal to nor less than the predetermined threshold time period, and shifts the image-forming apparatus 300 into the "sleep mode with roller separation".

In S803, with regard to the record No. 502, CPU 311 compares the immediately preceding sleep mode time period (in the record No. 501) with the predetermined time period of 20 minutes, and determines that the immediately preceding sleep mode time period is 5 minutes and equal to or less than the predetermined time period of 20 minutes. Thus, the CPU 311 shifts the image-forming apparatus 300 into the "sleep mode without roller separation".

It is to be understood that the present invention may also be accomplished by supplying a system or an apparatus with a storage medium in which a program code of software, which realizes the functions of the above described embodiments is stored and by causing a computer (or CPU or MPU) of the system or apparatus to read out and execute the program code stored in the storage medium.

In that case, the program code itself read from the storage medium realizes the functions of the above described embodiments, and therefore the program code and the storage medium in which the program code is stored constitute the present invention.

Examples of the storage medium for supplying the program code include a floppy (registered trademark) disk, a hard disk, and a magnetic-optical disk, an optical disk such as a CD-ROM, a CD-R, a CD-RW, a DVD-ROM, a DVD-RAM, a DVD-RW, a DVD+RW, a magnetic tape, a nonvolatile memory card, and a ROM. The program code may be downloaded via a network.

Further, it is to be understood that the functions of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of the above described embodiments may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-154401 filed Jun. 11, 2007, which is hereby incorporated by reference herein in its entirety.

What is claimed is:

1. An image-forming apparatus comprising:

a fixing unit having a fixing part and a pressurizing part disposed for pressure contact with the fixing part, the fixing unit being adapted to pass a record medium to between the fixing part and the pressurizing part, and to fix an image formed on the record medium using the fixing part and the pressurizing part;

a separating unit configured to separate the fixing part and the pressurizing part; and a control unit configured to shift the image-forming apparatus into a power saving state without the fixing part and the pressurizing part being separated by said separating unit, wherein said control unit causes said separating unit to separate the fixing part and the pressurizing part, in a case where a condition to return the image-forming apparatus from the power saving state is not satisfied, after elapse of a predetermined time period from when the image-forming apparatus has been shifted into the power saving state.

2. The image-forming apparatus according to claim 1, further comprising:

a rolling-control unit configured to rotate the fixing part and the pressurizing part, wherein said rolling-control unit causes the fixing part and the pressurizing part to rotate in a case where the image-forming apparatus has been shifted into the power saving state without the fixing part and the pressurizing part being separated by said separating unit.

3. An image-forming apparatus including a fixing unit having a fixing part and a pressurizing part disposed for pressure contact with the fixing part, the fixing unit being adapted to fix an image formed on a record medium using the fixing part and the pressurizing part, the image-forming apparatus comprising:

a separating unit configured to perform a separating action to separate the fixing part and the pressurizing part;

a counting unit configured to count a number of times of separation between the fixing part and the pressurizing part by the separating action of said separating unit; and a control unit configured to control the separating action of said separating unit based on a result of the counting by said counting unit in a case where the image-forming apparatus is shifted into the power saving state.

4. The image-forming apparatus according to claim 3, wherein the image-forming apparatus has:

a first power saving mode in which, based on a result of the counting by said counting unit, the image-forming apparatus is shifted into the power saving state without the fixing part and the pressurizing part being separated; and a second power saving mode in which, based on a result of the counting by said counting unit, the image-forming apparatus is shifted into the power saving state with the fixing part and the pressurizing part being separated.

5. The image-forming apparatus according to claim 3, wherein said control unit causes said separating unit to separate the fixing part and the pressurizing part, in a case where a condition to return the image-forming apparatus from the power saving state is not satisfied, after elapse of a predetermined time period from when the image-forming apparatus has been shifted into the power saving state without the fixing part and the pressurizing part being separated.

6. The image-forming apparatus according to claim 3, further comprising:

a memory unit configured to store history information relating to separation between the fixing part and the pressurizing part by said separating unit, wherein said control unit controls the separating action of said separating unit based on the history information stored in said memory unit.

7. The image-forming apparatus according to claim 6, wherein said control unit controls the separating action of said separating unit based on information stored in said memory unit and relating to a time period for which the image-forming apparatus has previously been in the power saving state.

8. A control method for an image-forming apparatus comprising:

passing a record medium to between a fixing part and a pressurizing part;

fixing an image on the record medium using the fixing part and the pressurizing part, causing the image-forming apparatus to shift into a power saving state without the fixing part and the pressurizing part being separated; and separating the fixing part and the pressurizing part, in a case where a condition to return the image-forming apparatus from the power saving state is not satisfied, after elapse of a predetermined time period from when the image-forming apparatus has been shifted into the power saving state.

9. The control method according to claim 8, further comprising:

causing the fixing part and the pressurizing part to rotate in a case where the image-forming apparatus has been shifted into the power saving state without the fixing part and the pressurizing part being separated.

10. A control method for an image-forming apparatus including a fixing unit having a fixing part and a pressurizing part disposed for pressure contact with the fixing part, the fixing unit being adapted to fix an image formed on a record medium using the fixing part and the pressurizing part, the control method comprising:

counting a number of times of separation between the fixing part and the pressurizing part; and controlling the separation between the fixing part and the pressurizing part based on a result of the counting when the image-forming apparatus is shifted into the power saving state.

11. The control method according to claim 10, wherein the image-forming apparatus has:

a first power saving mode in which, based on a result of the counting, the image-forming apparatus is shifted into the power saving state without the fixing part and the pressurizing part being separated; and a second power saving mode in which, based on a result of the counting, the image-forming apparatus is shifted into the power saving state with the fixing part and the pressurizing part being separated.

12. The control method according to claim 10, further comprising:

separating the fixing part and the pressurizing part, in a case where a condition to return the image-forming apparatus from the power saving state is not satisfied, after elapse of a predetermined time period from when the image-forming apparatus has been shifted into the power saving state without the fixing part and the pressurizing part being separated.

13. The control method according to claim 10, further comprising:

causing a memory unit to store history information relating to separation between the fixing part and the pressurizing part;

wherein the separation between the fixing part and the pressurizing part is controlled based on the history information stored in the memory unit.

14. The control method according to claim 13, wherein the separation between the fixing part and the pressurizing part is controlled based on information stored in the memory unit and relating to a time period for which the image-forming apparatus has previously been in the power saving state.

15. A non-transitory computer-readable storage medium storing a computer-executable program for controlling an image-forming apparatus the computer-executable program comprising:

code to pass a record medium to between a fixing part and a pressurizing part;

code to fix an image on the record medium using the fixing part and the pressurizing part;

code to cause the image-forming apparatus to shift into a power saving state without the fixing part and the pressurizing part being separated; and code to separate the fixing part and the pressurizing part in a case where a condition to return the image-forming apparatus from the power saving state is not satisfied even after elapse of a predetermined time period from when the image-forming apparatus has been shifted into the power saving state.

16. A non-transitory computer-readable storage medium storing a computer-executable program for controlling an image-forming apparatus including a fixing unit having a fixing part and a pressurizing part disposed for pressure contact with the fixing part, the fixing unit being adapted to fix an image unfixedly formed on a record medium using the fixing part and the pressurizing part, the computer-executable program comprising:

code to count a number of times of separation between the fixing part and the pressurizing part; and code to control the separation between the fixing part and the pressurizing part based on a result of the counting when the image-forming apparatus is shifted into the power saving state.

17. An image forming apparatus comprising:

a fixing unit having a first part and a second part for applying pressure between the first part and the second part, the fixing unit being adapted to pass a record medium to between the first part and the second part, and to fix an image on the record medium using the first part and the second part; and a control unit adapted to control, from when the image forming apparatus shifts into a power saving state to when a predetermined time period elapses, the fixing unit to apply pressure between the first part and the second part, and to control, after the predetermined time period has elapsed, the fixing unit not to apply the pressure.

* * * * *